US008459772B2

(12) United States Patent
Katoh et al.

(10) Patent No.: US 8,459,772 B2
(45) Date of Patent: Jun. 11, 2013

(54) IMAGE FORMING APPARATUS AND METHOD FOR MAINTAINING HEAD

(75) Inventors: Satoshi Katoh, Miyagi (JP); Wataru Takahashi, Miyagi (JP); Koji Nagai, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 13/164,955

(22) Filed: Jun. 21, 2011

(65) Prior Publication Data

US 2012/0001976 A1 Jan. 5, 2012

(30) Foreign Application Priority Data

Jul. 2, 2010 (JP) ..... 2010-152212

(51) Int. Cl.
*B41J 29/38* (2006.01)
*B41J 2/01* (2006.01)

(52) U.S. Cl.
USPC ..... 347/16; 347/104

(58) Field of Classification Search
USPC ..... 347/5, 16, 101, 102, 104
See application file for complete search history.

(56) References Cited

U.S. PATENT DOCUMENTS 6,406,017 B1 * 6/2002 Yaneda ..... 271/276
8,025,390 B2 * 9/2011 Phillips et al. ..... 347/104
8,123,348 B2 * 2/2012 Igi et al. ..... 347/102

FOREIGN PATENT DOCUMENTS

JP 2004-268477 9/2004
JP 2007-168277 7/2007

* cited by examiner

*Primary Examiner* — An Do
(74) *Attorney, Agent, or Firm* — Cooper & Dunham LLP

(57) ABSTRACT

An image forming apparatus includes an endless belt having holes facing a head and to transfer a recording medium in a transferring direction perpendicular to an array direction of nozzles in the head, a driving unit to drive the endless belt, a driving speed control unit to control a driving speed of the endless belt, and a maintenance discharge amount acquisition unit to acquire an amount of a recording liquid to be discharged from the nozzles of the head to allow the amount of the recording liquid to be passed through the holes in the endless belt for performing maintenance during a non-image forming operation. The driving speed control unit sets the driving speed of the endless belt based on the amount of the recording liquid to be discharged from the nozzles acquired by the maintenance discharge amount acquisition unit.

8 Claims, 8 Drawing Sheets

FIG.6

| | CONDITION | | |
|---|---|---|---|
| WAITING TIME | LONG<br>INCREASE | ⇕ | SHORT<br>DECREASE |
| ENVIRONMENT TEMPERATURE | LOW<br>INCREASE | ⇕ | HIGH<br>DECREASE |
| ENVIRONMENT HUMIDITY | LOW<br>INCREASE | ⇕ | HIGH<br>DECREASE |
| STANDING CONDITION | DECAPPED<br>INCREASE | ⇕ | CAPPED<br>DECREASE |
| HEAD TEMPERATURE | HIGH<br>INCREASE | ⇕ | LOW<br>DECREASE |

IMAGE FORMING APPARATUS AND METHOD FOR MAINTAINING HEAD

BACKGROUND OF THE INVENTION

1. Field of the Invention

The invention generally relates to an image forming apparatus and a method for maintaining a head provided in the image forming apparatus. More specifically, the invention relates to an inkjet image type forming apparatus including a head that discharges a recording liquid such as ink to form images, and a method for maintaining the head in such an image forming apparatus.

2. Description of the Related Art

An inkjet image forming apparatus generally includes a head with micronozzles to spray droplets of a recording liquid. Such an inkjet image forming apparatus has various inkjet systems. For example, the image forming apparatus with a movable actuator inkjet system may be typically represented by piezoelectric inkjet printers and those with a film boiling inkjet system may be typically represented by thermal inkjet printers (e.g., Japanese Patent Application Publication No. 2004-268477 and Japanese Patent Application Publication No. 2007-168277).

In such image forming apparatuses, recording heads are generally provided with corresponding caps. These caps are attached to the respective heads to avoid nozzle clogging and/or reduction of the recording liquid due to dryness while the heads are not driven (e.g., Japanese Patent Application Publication No. 2004-268477). However, simply providing the caps on the heads while the heads are not driven may not completely prevent the clogging of the nozzles and the reduction of the recording liquid due to dryness. Other technical proposals have been disclosed to improve liquid jet performance of the nozzles. Examples of such techniques of nozzle maintenance are disclosed in Japanese Patent Application Publication No. 2004-268477 and Japanese Patent Application Publication No. 2007-168277. According to these nozzle maintenance techniques, the recording liquid is discharged into the caps provided for the heads, or the recording liquid is forcefully discharged while images are not formed (these types of recording liquid discharge may hereinafter be called "non-image forming discharge").

Japanese Patent Application Publication No. 2007-168277 discloses an example of an image forming apparatus to which such nozzle maintenance techniques are applied. The disclosed image forming apparatus includes an endless belt to transfer a recording medium such as paper to a counterpart region facing the heads, where the recording liquid is discharged via holes provided in the endless belt without transferring the paper.

However, with such a configuration, where the recording liquid is discharged via the holes in the endless belt, the endless belt may be contaminated or it may take a long time to complete the non-image forming discharge. That is, part of recording liquid droplets may be attached to a surface of the endless belt without passing through its holes while conducting the non-image forming discharge. In such a case, recording media (e.g., paper) subsequently transferred by the endless belt may be contaminated or other components arranged inside the image forming apparatus may be contaminated while images are formed on the recording media. However, if the amount of recording liquid for the non-image forming discharge is simply reduced per hour to avoid such contamination of the endless belt and other components with the recording liquid, it may take a long time to complete the non-image forming discharge. In addition, since the endless belt is provided with the holes, airflow disturbance near the belt surface may be caused by the belt travelling speed. Thus, recording liquid jetting directions may be misaligned, which may also contaminate the belt surface.

SUMMARY OF THE INVENTION

It is a general object of at least one embodiment of the present invention to provide an image forming apparatus and a method for maintaining a head in the image forming apparatus capable of reducing contamination of a belt having holes through which a recording liquid is discharged as a non-image forming discharge for performing maintenance while transferring a recording medium to a counterpart region facing the head, and capable of reducing time for conducting the non-image forming discharge for performing the maintenance that substantially eliminates one or more problems caused by the limitations and disadvantages of the related art.

According to one embodiment, there is provided an image forming apparatus that includes an endless belt having plural holes facing a head and configured to transfer a recording medium in a transferring direction perpendicular to an array direction of nozzles provided in the head; a driving unit configured to rotationally drive the endless belt; a driving speed control unit configured to control a driving speed of the endless belt driven by the driving unit; and a maintenance discharge amount acquisition unit configured to acquire an amount of a recording liquid to be discharged from the nozzles of the head to allow the amount of the recording liquid to be passed through the holes in the endless belt for performing maintenance during a non-image forming operation. In the image forming apparatus, the driving speed control unit sets the driving speed of the endless belt based on the amount of the recording liquid to be discharged from the nozzles of the head to allow the amount of the recording liquid to be passed through the holes in the endless belt acquired by the maintenance discharge amount acquisition unit.

According to another embodiment, there is provided a method for maintaining a head in an image forming apparatus including an endless belt having plural holes facing the head. The method includes transferring a recording medium in a transferring direction perpendicular to an array direction of nozzles provided in the head; controlling a driving speed of the endless belt; and acquiring an amount of a recording liquid discharged from the nozzles to be passed through the holes in the endless belt for performing maintenance during a non-image forming operation. In the method, the driving speed of the endless belt is set based on the acquired amount of the recording liquid to be discharged from the nozzles of the head to allow the amount of the recording liquid to be passed through the holes in the endless belt.

BRIEF DESCRIPTION OF THE DRAWINGS

Other objects and further features of embodiments will be apparent from the following detailed description when read in conjunction with the accompanying drawings, in which:

FIG. 6 is a table summarizing tendency of an amount of a recording liquid to be discharged from nozzles for maintenance based on various conditions while no image is formed.

DESCRIPTION OF THE PREFERRED EMBODIMENTS

Figure 1:
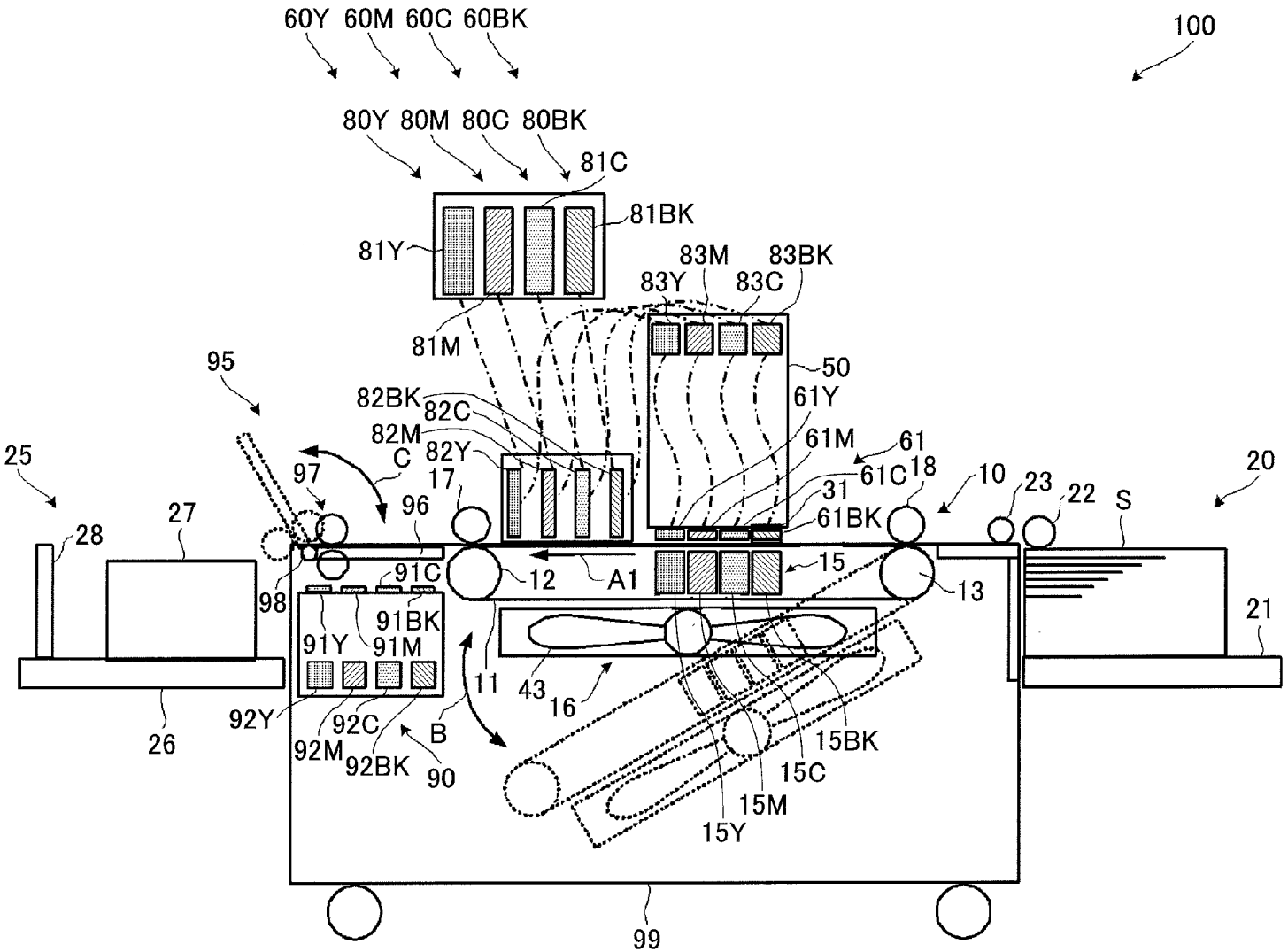
FIG. 1 is a schematic front diagram illustrating an image forming apparatus according to an embodiment of the invention.
Figure 2:
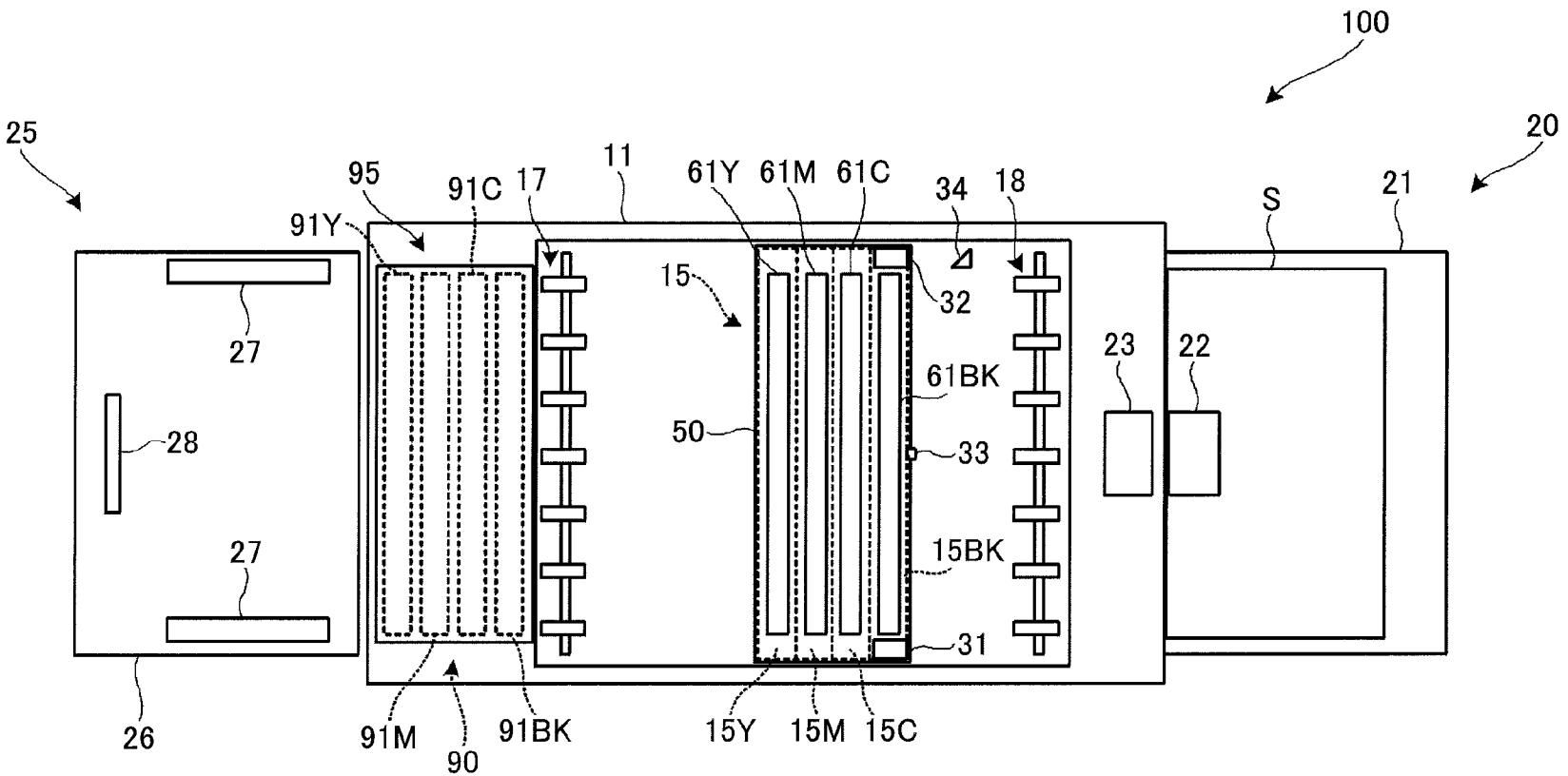
FIG. 2 is a schematic plan diagram illustrating the image forming apparatus illustrated in FIG. 1.

FIGS. 1 and 2 illustrate schematic diagrams of an image forming apparatus to which an embodiment of the invention is applied. An image forming apparatus 100 according to an embodiment is utilized as an inkjet printer configured to form full color images. The image forming apparatus 100 performs image forming processing based on image signals of image information received from outside.

The image forming apparatus 100 is configured to form images on sheet type recording media such as plain paper, OHP sheets, cardboard such as cards or postcards, or envelops. The image forming apparatus 100 is a single-side image forming apparatus configured to form images on a single-side of a sheet S used as a recording medium; however, it may be a double-side image forming apparatus configured to form images on both sides of the sheet S.

The image forming apparatus 100 includes liquid jet heads 61BK, 61C, 61M and 61Y as recording liquid jet heads (i.e., inkjet heads) to discharge respective recording liquids of black, cyan, magenta and yellow, and hence images of respective colors form an image.

In a main body 99 of the image forming apparatus 100, the heads 61BK, 61C, 61M and 61Y are arranged approximately at a middle portion of the main body 99 such that they face an upper surface of a transfer unit 10 provided as a transfer part for transferring the sheet S in a left direction of FIG. 1. The heads 61BK, 61C, 61M and 61Y form a head part 61 that is a head array configured to print or form images by discharging recording liquid droplets on the sheet S transferred by the transfer unit 10. The heads 61BK, 61C, 61M and 61Y are aligned in this order from an upstream side in the sheet S transferring direction, that is, a counterclockwise direction indicated by an arrow A1 in FIG. 1. As described above, the image forming apparatus 100 includes a tandem configuration, in which the heads 61BK, 61C, 61M and 61Y face a sheet S transferring path and are arranged in parallel with the arrow A1 direction. Note that subscripts BK, C, M and Y provided after reference numerals in the figure indicate the components for respective colors of black, cyan, magenta and yellow.

Figure 3:
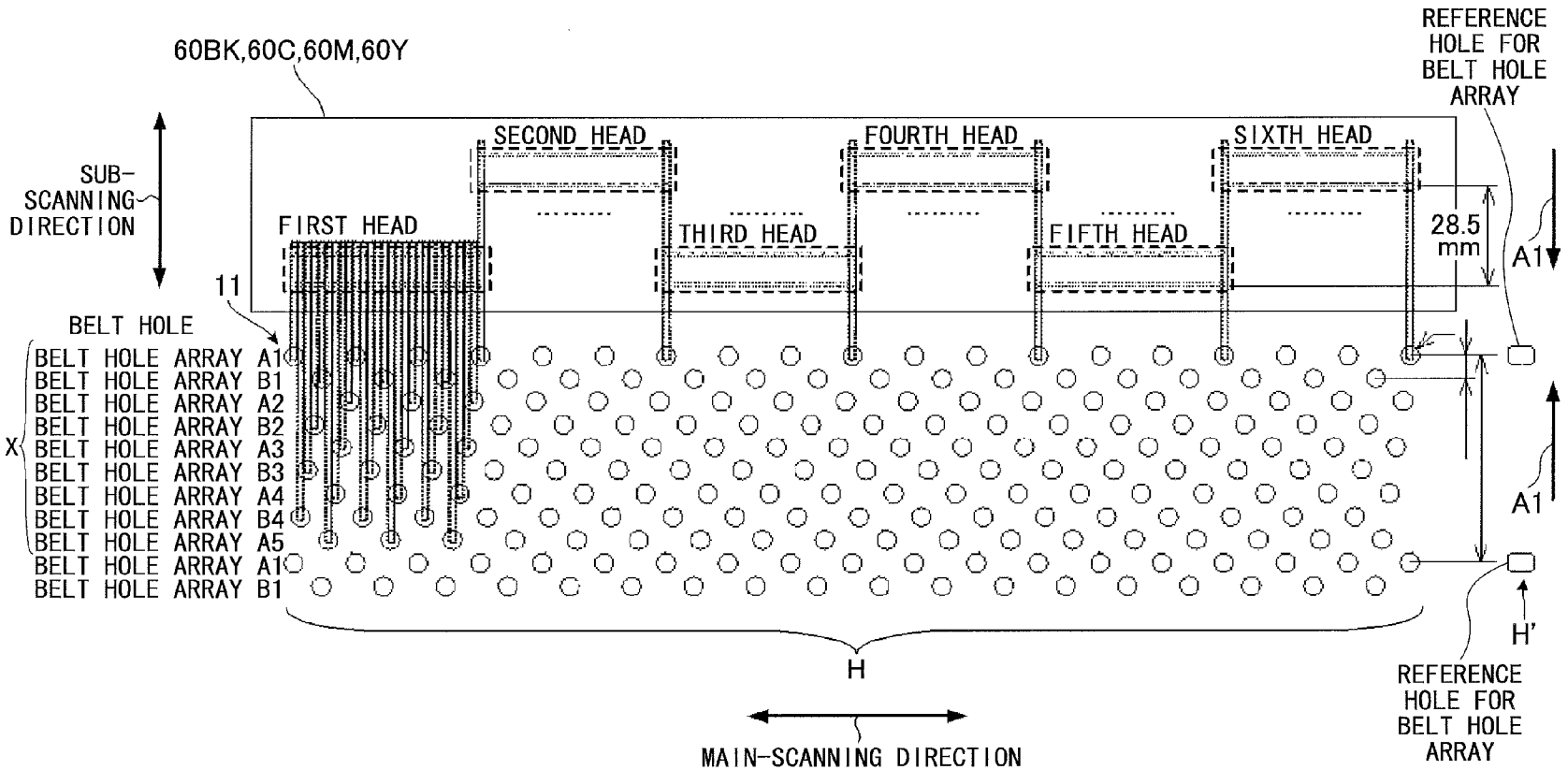
FIG. 3 is a conceptual diagram illustrating heads and a belt provided with holes in relation to the heads arranged in the image forming apparatus illustrated in FIG. 1.

The heads 61BK, 61C, 61M and 61Y are provided in inkjet devices 60BK, 60C, 60M and 60Y as recording liquid jet devices for forming black (BK), cyan (C), magenta (M) and yellow (Y) images. Note that the respective heads 61BK, 61C, 61M and 61Y are provided in the inkjet devices 60BK, 60C, 60M and 60Y in a direction of a main-scanning direction of the sheet P in FIG. 1 such that the heads 61BK, 61C, 61M and 61Y are arranged in parallel with zigzag alignment in a horizontal direction as illustrated in FIG. 3.

Nozzles to jet recording liquid droplets are provided in the respective heads 61BK, 61C, 61M and 61Y, which are arranged such that the respective heads 61BK, 61C, 61M and 61Y cover a full width of the sheet P of its maximum width as illustrated in FIG. 1. The nozzles having a diameter of 20 μm are arranged at 150 dpi. The nozzle discharges an approximately 23-picoliter liquid droplet a droplet diameter of which is approximately 17.6 μm. Note that the arrangement of the heads 61BK, 61C, 61M and 61Y is not limited to that illustrated in FIG. 3 where the heads 61BK, 61C, 61M and 61Y are arranged in parallel in the main-scanning direction and in the sub-scanning direction. The heads 61BK, 61C, 61M and 61Y may be uniformly arranged only in the main-scanning direction as schematically illustrated in FIG. 2.

The heads 61BK, 61C, 61M and 61Y may be arranged such that black, cyan, magenta and yellow recording liquid droplets discharged from the heads 61BK, 61C, 61M and 61Y are sequentially superimposed one another to form an image on the surface of the sheet S at a counterpart region facing the heads 61BK, 61C, 61M and 61Y while the sheet S is transferred by the transfer unit 10.

Specifically, the respective colors of recording liquid droplets are discharged by the heads 61BK, 61C, 61M and 61Y from the upstream side to the downstream side of the arrow A1 direction (i.e., a recording medium transferring direction) in FIG. 1 at slightly different times. Thus, black, cyan, magenta and yellow image forming regions, to which respective colors of recording liquid droplets discharged by the heads 61BK, 61C, 61M and 61Y are overlapped, are located at the same position on the surface of the sheet S. Note that the image forming apparatus 100 is a direct image forming apparatus in which the recording liquids discharged from the heads 61BK, 61C, 61M and 61Y are directly applied to the surface of the sheet S to form an image on the surface of the sheet S.

As illustrated in FIGS. 1 and 2, the image forming apparatus 100 includes the inkjet devices 60BK, 60C, 60M and 60Y respectively having the heads 61BK, 61C, 61M and 61Y, the transfer unit 10, a sheet feed unit 20 capable of accommodating numerous sheets Sand configured to feed a top one of the sheets S to the transfer unit 10, and a discharged sheet receiving base 25 capable of accumulating the numerous printed (image formed) sheets P that are sequentially or intermittently transferred by the transfer unit 10.

The image forming apparatus 100 further includes a transfer guide part 95 between the transfer unit 10 and the discharged sheet receiving base 25 to guide the printed sheets P transferred by the transfer unit 10 to the discharged sheet receiving base 25, and a cleaning unit 90 as a head cleaning device configured to clean nozzles of the heads 61BK, 61C, 61M and 61Y, that is, head nozzle surfaces of the heads 61BK, 61C, 61M and 61Y below the transfer guide part 95.

The image forming apparatus 100 further includes a carriage 50 as a head support member configured to uniformly support the heads 61BK, 61C, 61M and 61Y, a not-shown head moving drive unit including a motor and the like as a not-shown drive source configured to drive and move the carriage 50 to one of a home position for forming images and a cleaning position for cleaning the heads 61BK, 61C, 61M and 61Y.

As illustrated in FIG. 2, the image forming apparatus 100 further includes a liquid droplet jet failure detector 31 configured to detect recording liquid jetting conditions of the heads 61BK, 61C, 61M and 61Y with jetting failure detecting liquid droplets discharged from the heads 61BK, 61C, 61M and 61Y, a belt width direction position detecting unit 32 configured to detect a position of a transfer belt 11 in a transfer belt width direction and detect a transferring condition of the transfer belt 11, and a recording position detecting unit 33 configured to detect jetted positions or recorded positions of the recording liquid in a width direction discharged by the heads 61BK, 61C, 61M and 61Y.

Figure 4:
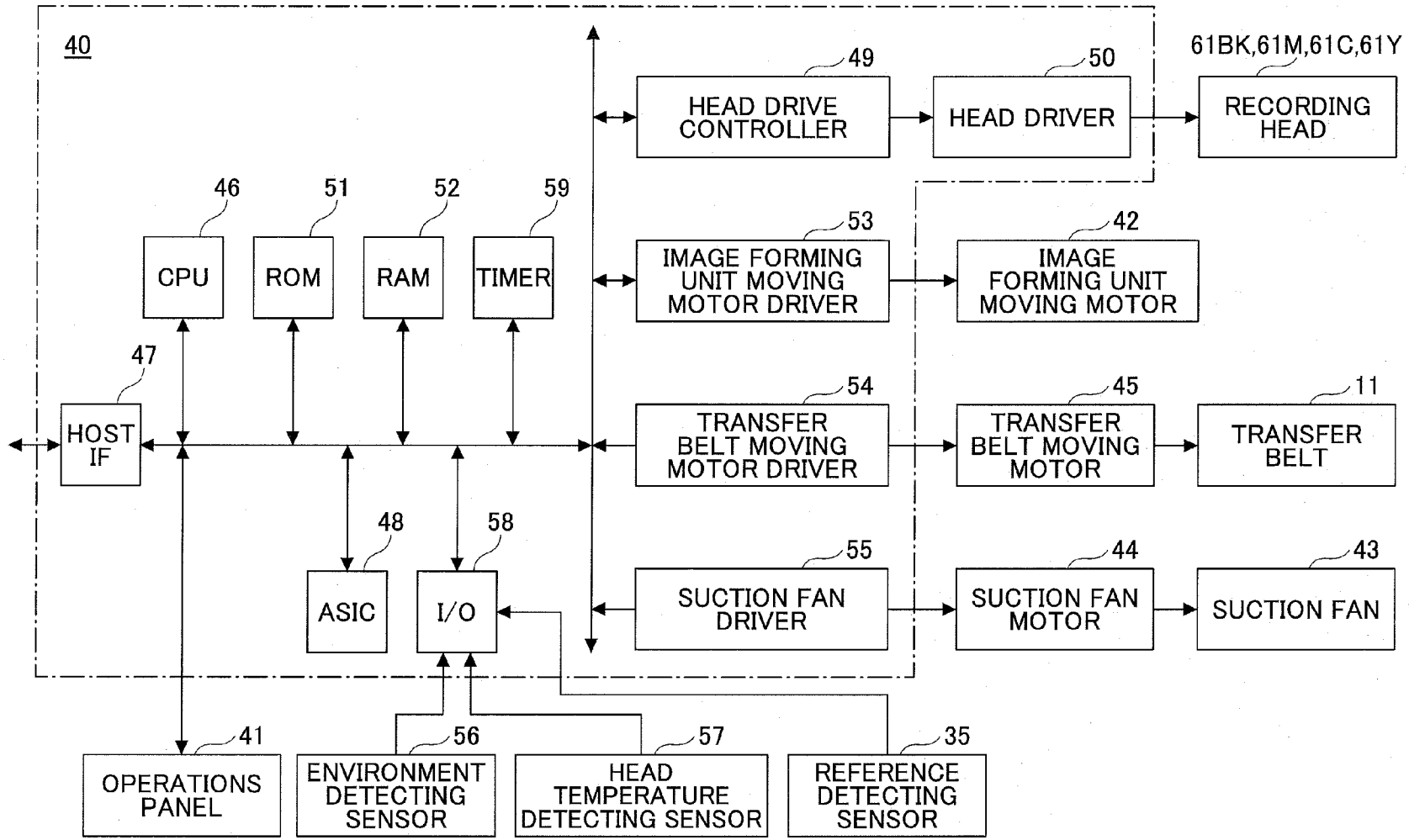
FIG. 4 is a control block diagram of the image forming apparatus illustrated in FIG. 1.

As illustrated in FIG. 4, the image forming apparatus 100 further includes a CPU 46 configured to control an overall operation of the image forming apparatus 100; a controller 40 as a control unit including a ROM 51 and a RAM 52 as memories; an operations panel 41 via which the operation of the image forming apparatus 100 such as an image formation initiating instruction is set; an environment detecting sensor 56 as an environment detecting unit (serving as a temperature detecting unit and a humidity detecting unit) configured to detect ambient temperature and humidity related to a usage environment inside the main body 99, specifically, around the heads 61BK, 61C, 61M and 61Y; a head temperature detecting sensor 57 serving as a head temperature detecting unit configured to detect respective temperatures of the heads 61BK, 61C, 61M and 61Y; and a reference detecting sensor 35 as a reference detecting unit configured to optically detect a later described reference hole H' illustrated in FIG. 3, which is formed in the transfer belt 11 to indicate time for causing the heads 61BK, 61C, 61M and 61Y to discharge the recording liquid.

As illustrated in FIG. 1, the transfer unit 10 is arranged such that the transfer unit 10 faces the heads 61BK, 61C, 61M and 61Y. The transfer unit 10 includes the transfer belt 11 formed of an endless belt configured to endlessly travel in the arrow A1 direction, a driving roller 12 serving as a transfer driving roller over which the transfer belt 11 is looped, and a driven roller 13 serving as a transfer driven roller over which the transfer belt 11 is looped in the same manner as the driving roller 12.

The transfer unit 10 further includes an ink receiver 15 arranged beneath an upper part of the transfer belt 11 that faces the heads 61BK, 61C, 61M and 61Y, and a suction unit 16 arranged below a lower part of the transfer belt looped over the driving roller 12 and the driven roller 13, and configured to suction and hold the sheet S onto the transfer belt 11.

The transfer unit 10 further includes guide rollers 17 and 18 respectively facing and contacting the driving roller 12 and the driven roller 13 via the transfer belt 11, a not-shown guide used for applying force to the guide rollers 17 and 18 due to its own weight, a not-shown unit rotating motor configured to rotationally drive the transfer unit 10 in B directions, and a transfer belt moving motor 45 serving as a belt drive unit configured to rotationally drive the driving roller 12.

The transfer belt moving motor 45 rotationally drives the driving roller 12 such that the transfer belt 11 rotationally travels in the arrow A1 direction. The rotational speed (revolutions per hour) of the transfer belt moving motor 45 is variable. The transfer belt moving motor 45 is drive-controlled by the controller 40. The driven roller 13 is rotationally driven according to the traveling of the transfer belt 11 that is rotationally driven by the driving roller 12 in the arrow A1 direction. The guide rollers 17 and 18 are rotationally driven according to the traveling of the transfer belt 11.

Figure 5:
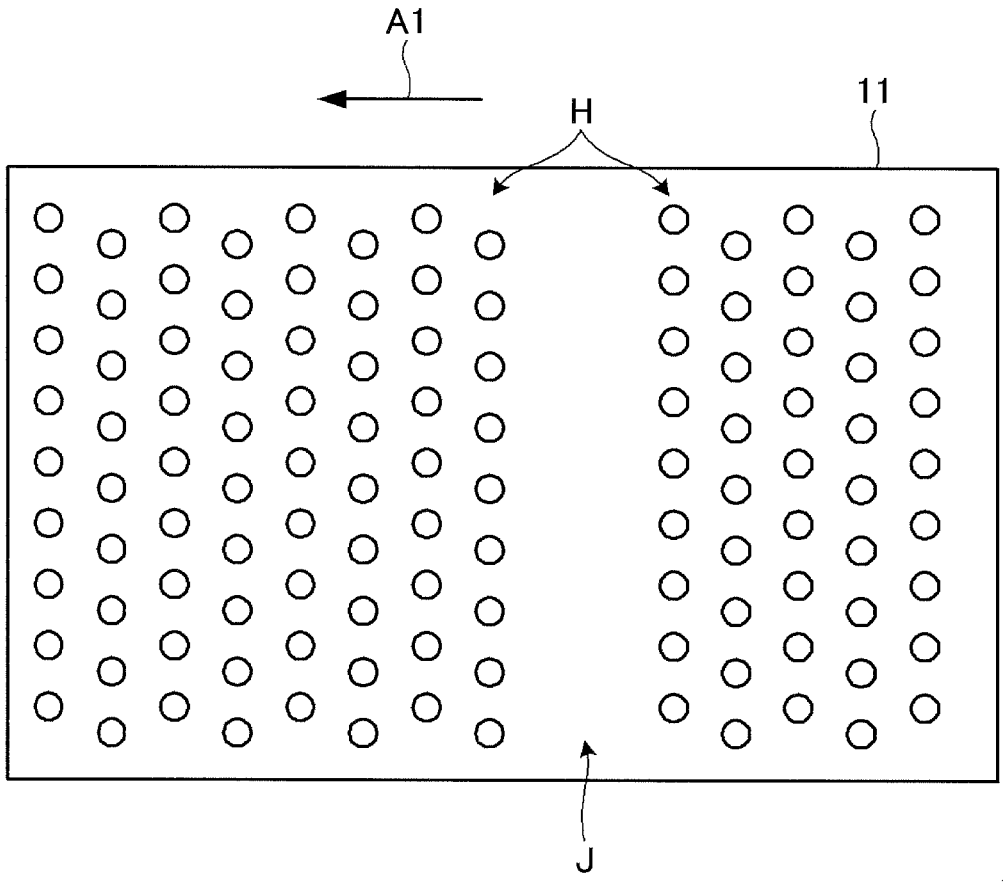
FIG. 5 is a schematic plan diagram illustrating the belt in the image forming apparatus illustrated in FIG. 1 that is provided with the holes.

The transfer belt 11 includes numerous suction holes H as belt holes as illustrated in FIGS. 3 and 5. In FIG. 5, "J" indicates a sealing part that is a connecting part of the endless belt 11. The transfer belt 11 further includes a mark 34 at its end part in the width direction, which is configured to be detected by the belt width direction position detecting unit 32.

When the recording liquid is jetted from the heads 61BK, 61C, 61M and 61Y onto the transfer sheet 11 in order to perform the later described non-image forming discharge, the jetted recording liquid droplets pass through the holes H formed in the transfer belt 11 to drop downward. The recording liquid droplets passed through the transfer belt 11 are received by the ink receiver 15. The shape of the hole H is described later along with the non-image forming discharge.

The ink receiver 15 includes non-image forming liquid discharge receivers 15BK, 15C, 15M and 15Y configured to respectively receive black, cyan, magenta and yellow recording liquids discharged from the heads 61BK, 61C, 61M and 61Y and having passed through the transfer belt 11. The non-image forming liquid discharge receivers 15BK, 15C, 15M and 15Y are located at respective positions such that the non-image forming liquid discharge receivers 15BK, 15C, 15M and 15Y respectively face the heads 61BK, 61C, 61M and 61Y via the transfer belt 11 when the carriage 50 resides in the home position.

The suction unit 16 includes a suction fan 43 configured to generate negative pressure by its rotation, and a suction fan motor 44 illustrated in FIG. 4 configured to drive the rotation of the suction fan 43. The suction unit 16 is configured to suction the sheet S onto the transfer belt 11 via the holes H formed in the transfer belt 11. The holes H also serve as suction holes for the suction unit 16 to suction the sheet S onto the transfer belt 11. That is, the holes H are utilized when the sheet S is held onto the transfer belt 11 and when the non-image forming liquid is passed through the transfer belt 11. The sheet S, which is held onto the transfer belt 11 by the negative pressures of the holes H, is transferred in the recording medium transferring direction by rotational traveling of the transfer belt 11 in the arrow A1 direction. That is, the sheet S is transferred by the transfer unit 10 from the sheet feed unit 20 to the discharged sheet receiving base 25 via the transfer guide part 95.

A not-shown unit rotating motor is configured to rotate the transfer unit 10 to one of the home position illustrated with solid lines and a retracted position illustrated with dotted lines illustrated in FIG. 1. The unit rotating motor rotates the transfer unit 10 to the retracted position to secure space for moving the carriage 50 and the heads 61BK, 61C, 61M and 61Y when the not-shown head moving drive unit moves the carriage 50 together with the heads 61BK, 61C, 61M and 61Y to the cleaning positions. Note that the transfer unit 10 may include a fixing unit configured to fix the recording liquid that forms images on the sheet S.

The sheet feed unit 20 includes a sheet feed tray 21 capable of accommodating numerous sheets S, a separation roller 22 configured to separate a top sheet from the rest of the sheets S accommodated in the sheet feed tray 21, a sheet feed roller 23 configured to feed the separated sheet S to the transfer unit 10, and a motor or the like as a not-shown drive unit configured to rotationally drive the sheet feed roller 23 according to the recording liquid jetting times of the heads 61BK, 61C, 61M and 61Y to feed the sheet S.

The discharged sheet receiving base 25 includes a discharged sheet receiving tray 26 capable of accommodating numerous image-formed sheets S, a pair of side fences 27 configured to align the sheets S in a direction perpendicular to surfaces of the sheets S and an end fence 28 configured to align a front end of the sheets S (i.e., left ends in FIG. 1).

The head moving drive unit slidably moves the carriage 50 together with the head part 61 in the arrow A1 direction. Accordingly, when the head moving drive unit stops the carriage 50 at the home position or the cleaning position, the heads 61BK, 61C, 61M and 61Y are located at respective image forming positions (or recording liquid jetting positions) at which the heads 61BK, 61C, 61M and 61Y discharge respective recording liquids to the sheet S or the non-image forming liquids to the respective non-image forming liquid discharge receivers 15BK, 15C, 15M and 15Y, or at respective cleaning positions at which the heads 61BK, 61C, 61M and 61Y are cleaned. The head moving drive unit moves the carriage 50 to the cleaning position to place the heads 61BK, 61C, 61M and 61Y at the respective cleaning positions when a predetermined condition is satisfied after the images are formed, for example, on a predetermined number of sheets P.

The transfer guide part 95 includes a guide plate 96 as a transfer guide for guiding the image-formed sheet P transferred via the transfer unit 10 toward the discharged sheet receiving base 25, a discharge roller 97 configured to move the image-formed sheet P on the guide plate 96 to discharge the image-formed sheet P to the discharged sheet receiving base 25, a spindle 98 arranged downstream in the recording medium transferring direction of the guide plate 96 and serving as a fulcrum of the guide plate 96 and the discharge roller 97, and a not-shown guide part rotating motor configured to rotate the spindle 98 to rotationally drive the guide plate 96 and the discharge roller 97 in C directions.

The not-shown guide part rotating motor is configured to rotate the transfer guide part 95 to one of the home position to cover the cleaning unit 90 from an upper position as illustrated with the solid line and the retracted position to expose the cleaning unit 90 in an upward direction illustrated with the dotted line illustrated in FIG. 1, and fix the position of the transfer guide part 95. The guide part rotating motor rotates, after the image forming operation is terminated, the transfer guide part 95 to the retracted position to allow the cleaning unit 90 to face the heads 61BK, 61C, 61M and 61Y when the not-shown head moving drive unit moves the heads 61BK, 61C, 61M and 61Y to the cleaning positions for cleaning the heads 61BK, 61C, 61M and 61Y.

In a state where the transfer guide part 95 is located at the retracted position and the heads 61BK, 61C, 61M and 61Y are located at the respective cleaning positions, the cleaning unit 90 includes head cleaning units 91BK, 91C, 91M and 91Y configured to clean the respective heads 61BK, 61C, 61M and 61Y, and suction pumps 92BK, 92C, 92M and 92Y.

The head cleaning units 91BK, 91C, 91M and 91Y are aligned in this order along the sub-scanning direction that is an aligned direction of the heads 61BK, 61C, 61M and 61Y. Similar to the heads 61BK, 61C, 61M and 61Y, in the image forming apparatus 100, the head cleaning units 91BK, 91C, 91M and 91Y are arranged such that the head cleaning units 91BK, 91C, 91M and 91Y cover a full width of a type of the sheet P having the greatest width among various types of the sheets P in the width direction. The head cleaning units 91BK, 91C, 91M and 91Y serve as respective caps configured to cap the heads 61BK, 61C, 61M and 61Y located at the cleaning positions and also serve as respective wiper blades configured to remove ink attached to the nozzle surfaces of the heads 61BK, 61C, 61M and 61Y located at the cleaning positions.

The suction pumps 92BK, 92C, 92M and 92Y respectively clean the heads 61BK, 61C, 61M and 61Y on which the head cleaning units 91BK, 91C, 91M and 91Y serving as respective caps are attached by suctioning the respective colors of ink from the heads 61BK, 61C, 61M and 61Y via the head cleaning units 91BK, 91C, 91M and 91Y.

The carriage 50 is uniformly attached to the heads 61BK, 61C, 61M and 61Y and is detachably attached to the main body 99 in order to replace, when the heads 61BK, 61C, 61M and 61Y are deteriorated, the deteriorated heads 61BK, 61C, 61M and 61Y with the respective new ones or to facilitate the maintenance of the heads 61BK, 61C, 61M and 61Y. Further, the heads 61BK, 61C, 61M and 61Y are also individually detachable from the main body 99 in order to replace, when any of the heads 61BK, 61C, 61M and 61Y are deteriorated, the deteriorated one of the heads 61BK, 61C, 61M and 61Y with the respective new one or to facilitate the maintenance of the heads 61BK, 61C, 61M and 61Y. Thus, the replacement or the maintenance of the heads may be facilitated.

Although the inkjet devices 60BK, 60C, 60M and 60Y utilize different colors, they have approximately the same configurations. The inkjet devices 60BK, 60C, 60M and 60Y are arranged in parallel as illustrated in FIG. 3 in the main-scanning direction that is the width direction of the sheet P perpendicular to the sub-scanning direction that is the arrow A1 direction. The heads 61BK, 61C, 61M and 61Y include not-shown numerous nozzles linearly arranged in the main-scanning direction and are configured to generate recording liquid droplets. The heads 61BK, 61C, 61M and 61Y are line type recording heads, the inkjet devices 60BK, 60C, 60M and 60Y are head fixed full line configurations, and the image forming apparatus 100 is a line-type image forming apparatus, that is, a line-type inkjet recording apparatus. Note that the zigzag aligned heads may include linearly aligned nozzles. The main-scanning direction matches the nozzle aligned direction.

As illustrated in FIG. 1, the inkjet devices 60BK, 60C, 60M and 60Y respectively include the heads 61BK, 61C, 61M and 61Y and ink supply devices 80BK, 80C, 80M and 80Y configured to supply ink to the heads 61BK, 61C, 61M and 61Y as liquid supply devices in a supply system.

The ink supply devices 80BK, 80C, 80M and 80Y include ink cartridges 81BK, 81C, 81M and 81Y as main tanks (main liquid tanks) containing respective colors of ink and configured to supply the respective colors of ink to the heads 61BK, 61C, 61M and 61Y, and closed sub-tanks 82BK, 82C, 82M and 82Y configured to temporarily store the respective colors of ink from the ink cartridges 81BK, 81C, 81M and 81Y.

Further, the ink supply devices 80BK, 80C, 80M and 80Y respectively include distributing tubes 83BK, 83C, 83M and 83Y configured to distribute the respective colors of ink temporarily stored in the sub-tanks 82BK, 82C, 82M and 82Y to the heads 61BK, 61C, 61M and 61Y as ink distributers. The distributing tubes 83BK, 83C, 83M and 83Y are supported together with the heads 61BK, 61C, 61M and 61Y by the carriage 50 above the heads 61BK, 61C, 61M and 61Y.

The ink cartridges 81BK, 81C, 81M and 81Y are connected to the sub-tanks 82BK, 82C, 82M and 82Y via respective supply paths implemented by tubes configured to internally supply respective colors of ink from the sub-tanks 82BK, 82C, 82M and 82Y to the ink cartridges 81BK, 81C, 81M and 81Y as illustrated by dash-dot lines in FIG. 1. Likewise, the sub-tanks 82BK, 82C, 82M and 82Y are connected to the distributing tubes 83BK, 83C, 83M and 83Y via respective supply paths implemented by tubes configured to internally supply respective colors of ink from the distributing tubes 83BK, 83C, 83M and 83Y to the sub-tanks 82BK, 82C, 82M and 82Y; and in addition, the distributing tubes 83BK, 83C, 83M and 83Y are connected to the heads 61BK, 61C, 61M and 61Y via respective supply paths implemented by tubes configured to internally supply respective colors of ink from the distributing tubes 83BK, 83C, 83M and 83Y to the heads 61BK, 61C, 61M and 61Y as illustrated by dash-dot lines in FIG. 1.

Thus, the ink cartridges 81BK, 81C, 81M and 81Y, the sub-tanks 82BK, 82C, 82M and 82Y, the distributing tubes 83BK, 83C, 83M and 83Y, and the heads 61BK, 61C, 61M and 61Y are arranged in this order in a direction from upstream to downstream of an ink flow.

The appropriate negative pressures are maintained in the sub-tanks 82BK, 82C, 82M and 82Y by the differential hydraulic pressure head in order to maintain meniscuses of the nozzles of the heads 61BK, 61C, 61M and 61Y. The inkjet devices 60BK, 60C, 60M and 60Y, and the ink supply devices

80BK, 80C, 80M and 80Y employ a natural liquid supply system as an ink supply method.

The ink cartridges 81BK, 81C, 81M and 81Y are also detachable from the main body 99 in order to replace, when a small amount of the corresponding color of ink remains in any of the ink cartridges 81BK, 81C, 81M and 81Y, the corresponding one of the ink cartridges 81BK, 81C, 81M and 81Y with the respective new one or to facilitate the maintenance of the ink cartridges 81BK, 81C, 81M and 81Y.

The inkjet devices 60BK, 60C, 60M and 60Y include piezoelectric elements as actuators configured to cause the nozzles to jet the recording liquid droplets onto the sheet S. The nozzles jet the recording liquid droplets based on voltage pulses applied to the piezoelectric elements attached to the inkjet devices 60BK, 60C, 60M and 60Y. The inkjet devices 60BK, 60C, 60M and 60Y may include other deformable, movable piezoelectric actuators or thermal actuators.

The recording liquid is watercolor pigment ink containing a corresponding one of coloring materials of black, cyan, magenta and yellow, a dispersant of the coloring material, and a solvent. The main body 99 includes a front side plate, a rear side plate, and a stay, which are not illustrated in the figure.

As illustrated in FIG. 4, the controller 40 causes, when image forming operations are performed, that is, printing operations are performed, the CPU 46 to retrieve printing data from the receiving buffer in a host IF 47 to analyze the retrieved printing data, and causes an ASIC 48 to sort the printing data and the like, or in some cases, carry out partial image processing and transfer the processed data to a head driver 49. The conversion of the image printing data into bitmap data, which is printing raster data, is carried out by a host side printer driver deploying the image data as the bitmap data to generate the printing raster data of the printing data, and the generated printing raster data are then transferred to the controller 40.

On receiving the printing raster data of the dot-pattern data, the head drive-controller 49 transmits the printing raster data as serial data to the head driver 50 in synchronization with the clock signals and also transmits latch signals at predetermined timing.

The head drive-controller 49 includes the ROM 51 (may be a dedicated ROM) that stores driving signal pattern data of driving waveform, and a driving waveform generator circuit including a waveform generator circuit having a D/A converter configured to D/A convert driving waveform data retrieved from the ROM 51, and an amplifier.

The head driver 50 includes a shift register configured to input serial data including the clock signals and the image data, a latch circuit configured to latch registry values by latch signals received from the head drive-controller 49, a level shifter serving as a level conversion circuit configured to change levels of output values of the latch circuit, and a switch unit serving as an analog switch array configured to control ON or OFF of the analog switch array. By controlling ON or OFF of the analog switch array, the head driver 50 selectively applies a predetermined driving waveform to the actuators of the heads 61BK, 61C, 61M and 61Y respectively provided in the inkjet devices 60BK, 60C, 60M and 60Y to drive the heads 61BK, 61C, 61M and 61Y so that the image forming data are printed to form dot patterns. Note that in this aspect, the head driver 50 serves as head driving unit to drive the heads 61BK, 61C, 61M and 61Y to discharge the respective recording liquids.

The controller 40 is supplied with an environmental temperature and an environmental humidity detected by the environment detecting sensor 56, and respective head temperatures of the heads 61BK, 61C, 61M and 61Y detected by the head temperature detecting sensor 57. The controller 40 includes an I/O port 58 configured to be supplied with signals from the reference detecting sensor 35.

The controller 40 includes a timer 59. The controller 40 measures respective non-ink discharge elapsed times of the heads 61BK, 61C, 61M and 61Y, namely, elapsed times from the previous discharge of ink from the heads 61BK, 61C, 61M and 61Y. That is, the controller 40 measures and computes respective standing times during which the images are not formed by discharging ink from the respective heads 61BK, 61C, 61M and 61Y. In this aspect, the timer 59 and the controller 40 may respectively serve as a non-discharge elapsed time measuring unit and a non-discharge elapsed time computing unit, or a standing time measuring unit and a standing time computing unit.

The controller 40 further includes an image forming unit moving motor driver 53 configured to drive-control an image forming unit moving motor 42, a transfer belt moving motor driver 54 configured to drive-control the transfer belt moving motor 45, and a suction fan driver 55 configured to drive-control a suction fan motor 44.

The transfer belt moving motor driver 54 may control the transfer belt moving motor 45 such that the transfer belt moving motor 45 changes its rotational speed (revolutions per hour) to change the driving speed, namely, the traveling speed or rotational speed (revolutions per hour) of the transfer belt 11.

In this aspect, the transfer belt moving motor driver 54 serves as a driving speed control unit configured to control the driving speed of the transfer belt 11 driven by the transfer belt moving motor 45.

When the image forming apparatus 100 having such a configuration forms a monochrome image in a condition illustrated in FIG. 1, the head 61BK discharges a black recording liquid to a predetermined position of the sheet S to form the monochrome image on the surface of the sheet S while the sheet S is fed from the sheet feed unit 20 and is then transferred by the transfer unit 10 by supplying a predetermined signal to instruct initiation of monochrome image formation. The sheet S carrying the monochrome image is further transferred by the transfer unit 10 and the transfer guide part 95, and is then discharged onto the discharged sheet receiving base 25.

When the image forming apparatus 100 having such a configuration forms a color image in the condition illustrated in FIG. 1, the heads 61BK, 61C, 61M and 61Y respectively discharge black, cyan, magenta and yellow recording liquids at a position on the surface of the sheet S such that respective colors of recording liquids are discharged at the same position on the surface of the sheet S by slightly shifting discharge timing from the upstream side to the downstream side in the arrow A1 direction while the sheet S is fed from the sheet feed unit 20 and is then transferred by the transfer unit 10 by supplying a predetermined signal instructing to initiate monochrome image formation. Accordingly, the discharged respective colors of recording liquids are superimposed at the same position of the sheet S to thereby form the color image on the sheet S. The sheet S carrying the color image is further transferred by the transfer unit 10 and the transfer guide part 95, and is then discharged onto the discharged sheet receiving base 25.

After having formed the corresponding images, the transfer guide part 95 is rotated to the retracted position and the heads 61BK, 61C, 61M and 61Y are moved to the respective cleaning positions, so that the head cleaning units 91BK, 91C, 91M and 91Y cap the heads 61BK, 61C, 61M and 61Y, thereby moisturizing the heads 61BK, 61C, 61M and 61Y.

By allowing the head cleaning units 91BK, 91C, 91M and 91Y to cap the heads 61BK, 61C, 61M and 61Y, the heads 61BK, 61C, 61M and 61Y are moistened, that is, thickening of the respective recording liquids in the heads 61BK, 61C, 61M and 61Y due to drying may be prevented. However, if standing time until initiation of a subsequent image forming operation is becoming longer; that is, if waiting time is becoming longer, if the environmental temperature is high, if the environmental humidity is low, or if the heads 61BK, 61C, 61M and 61Y have high temperatures, the viscosity of the recording liquids in the nozzles may be increased, which may induce instability in discharge of the recording liquids from the nozzles.

If the waiting time measured or computed by the timer 59 is a predetermined time or above, the controller 40 may optionally carry out maintenance of the heads 61BK, 61C, 61M and 61Y by discharging non-image forming recording liquid into the ink receiver 15. In the aspect of measuring and computing the waiting time, the timer 59 and the controller 40 may respectively serve as a waiting time measuring unit and a waiting time computing unit.

The "non-image forming discharge" indicates that the head driver 50 drives the heads 61BK, 61C, 61M and 61Y to discharge the respective colors of recording liquids to the non-image forming liquid discharge receivers 15BK, 15C, 15M and 15Y via the holes formed in the transfer belt 11, not for image formation but for performing maintenance of the nozzles of the heads 61BK, 61C, 61M and 61Y by renewing the recording liquids in the nozzles during the non-image forming operation. As a result, the recording liquid jetting performance of the nozzles of the head 61BK, 61C, 61M and 61Y may be restored.

If the waiting time measured by the timer 59 is equal to or greater than the predetermined time, the non-image forming discharge is carried out regardless of whether the heads 61BK, 61C, 61M and 61Y are capped by the head cleaning units 91BK, 91C, 91M and 91Y. For example, when forming the monochrome image, the heads 61C, 61M and 61Y do not discharge the recording liquids. Accordingly, if the waiting time is equal to or greater than the predetermined time, the heads 61C, 61M and 61Y are configured to perform the non-image forming discharge. The predetermined time in this case may become shorter than that when the heads 61C, 61M and 61Y are capped. Jetting pitch for discharging the recording liquids from the nozzles when the non-image forming discharge is performed is the same as the jetting pitch for discharging the recording liquids from the nozzles when image forming discharge is performed.

Note that in this embodiment, the waiting time is measured for the heads 61BK, 61C, 61M and 61Y individually; however, the waiting time may be measured for the respective nozzles in each of the heads 61BK, 61C, 61M and 61Y. In this manner, even if a color image is formed, the nozzles of the head located corresponding to an end portion in the width direction of the sheet S may have continuous non-discharge duration where the recording liquid is not discharged, based on a size of the sheet P or a type of the image formed. Accordingly, the nozzles of the head located corresponding to the end portion of the sheet S may carry out the non-image forming discharge, and further the amount of recording liquid may be reduced.

As illustrated in FIGS. 3 and 5, the non-image forming discharge is carried out by causing the recording liquids to pass through the holes H discontinuously formed in the width direction of the transfer belt 11 while the transfer belt 11 is rotationally driven. Accordingly, the holes H may need to be arranged such that the holes H match jetting positions of the recording liquids from the nozzles in the main-scanning direction that matches the nozzle array direction. Specifically, the holes H may need to be arranged corresponding to all the jetting positions of the recording liquids on the transfer belt 11 when the transfer belt 11 has no holes. That is, the holes H may be arranged such that any ink-jetted positions of the transfer belt 11 may have corresponding holes H in the main-scanning direction while the transfer belt 11 is rotationally driven.

Thus, to satisfy such an arrangement condition of the holes H, the holes H form a pattern X as a belt hole pattern that includes nine belt hole arrays the arrow A1, B1, A2, B2, . . . and A5 in the sub-scanning direction as illustrated in FIG. 5. Accordingly, any of the holes H may be arranged corresponding to any part of ink-jetted positions of the transfer belt 11 in the main-scanning direction. The pattern X is repeatedly formed in the transfer belt 11 in the arrow A1 direction. That is, plural of the patterns X are periodically formed in the transfer belt 11. Note that the number of belt hole arrays is not limited. The number of belt hole arrays may be two or more.

The pitch of the holes H in the sub-scanning direction is 6.65 mm and the diameter of the hole H is 5.4 mm. As described above, the nozzles having a diameter of 20 μm are arranged at 150 dpi. The nozzle discharges an approximately 23-picoliter liquid droplet a diameter of which is approximately 35.3 μm obtained by a spherical conversion. An effective diameter of the hole H, that is, an effective region utilized for practically allowing the liquid droplet to pass through the hole H may be in a range of 2 and 3 mm in the main-scanning direction and approximately 1 mm in the sub-scanning direction, based on consideration of the thickness of the transfer belt 11, a size of the liquid droplet in a thickness direction of the transfer belt 11, and a jetting speed of liquid droplet in the same thickness direction of the transfer belt 11.

The transfer belt 11 further includes, in addition to the holes H, reference holes H' as belt hole array reference holes formed corresponding to an upstream end of each pattern X in the arrow A1 direction. The reference holes H' are utilized as reference positions for corresponding patterns X in the arrow A1 direction, which are detected by the reference detecting sensor 35. By the reference detecting sensor 35 detecting the reference holes H', the controller 40 may accurately acquire the positions of the holes H in the arrow A1 and width directions and may determine jetting timing of the recording liquids discharged by the heads 61BK, 61C, 61M and 61Y. That is, the controller 40 selectively drives the nozzles in the main-scanning direction at appropriate timing such that the liquid droplets discharged from the nozzles are passed through the effective regions of the holes H based on detected timing of the reference holes H'.

Note that the reference holes H' are utilized not only to determine jetting timing of the liquid droplets for the non-image forming discharge but also to determine jetting timing of the liquid droplets for detecting jetting failure detecting liquid droplets detected by a liquid droplet jet failure detector 31.

In the non-image forming discharge, the amounts of the recording liquids to be discharged from the heads 61BK, 61C, 61M and 61Y necessary for the renewal of the recording liquids in the nozzles may be determined by the controller 40, based on the respective waiting times of the heads 61BK, 61C, 61M and 61Y measured by the timer 59, the environmental temperature and environmental humidity detected by the environment detecting sensor 56, capped conditions of the heads 61BK, 61C, 61M and 61Y capped by the head cleaning units 91BK, 91C, 91M and 91Y, and the respective temperatures of the heads 61BK, 61C, 61M and 61Y detected by the head temperature detecting sensor 57. The aforementioned respective waiting times of the heads 61BK, 61C, 61M and 61Y, the environmental temperature, the environmental humidity, the capped conditions of the heads 61BK, 61C, 61M and 61Y and the respective temperatures of the heads 61BK, 61C, 61M and 61Y may change the viscosity levels of the recording liquids in the nozzles of the heads 61BK, 61C, 61M and 61Y and the respective amounts of the recording liquids for the non-image forming discharge. Note that since each of the liquid droplets includes approximately a predetermined volume, the amount of the recording liquid may substantially be equivalent to the number of recording liquid droplets.

In the non-image forming discharge, the amounts of the recording liquids discharged from the nozzles of the heads 61BK, 61C, 61M and 61Y may increase as the waiting times get longer, as the environmental temperature and the environmental humidity get lower when the heads 61BK, 61C, 61M and 61Y are in decapped conditions, and as temperatures of the heads 61BK, 61C, 61M and 61Y get higher.

The controller 40 stores the amounts of the recording liquids to be discharged from the nozzles of the heads 61BK, 61C, 61M and 61Y for performing the non-image forming discharge in the ROM 51 in the form of a control sequence table created in a design process. In this aspect, the ROM 51 may serve as a non-image forming discharge amount storing unit or a non-image forming discharge droplet storing unit (hereinafter referred to as the "non-image forming discharge amount storing unit"). A condition (discharge amount determining condition) including respective waiting times of the heads 61BK, 61C, 61M and 61Y, the environmental temperature, the environmental humidity, and the capped conditions of the heads 61BK, 61C, 61M and 61Y but excluding the respective temperatures of the heads 61BK, 61C, 61M and 61Y may be used to determine a necessary discharge amount or necessary discharge drops (hereinafter referred to as the "necessary discharge amount") in the design process based on practical values of the discharge amount determining condition.

The controller 40 monitors whether the respective waiting times of the heads 61BK, 61C, 61M and 61Y measured by the timer 59 become a predetermined time or more. If the waiting times of the heads 61BK, 61C, 61M and 61Y measured by the timer 59 are equal to or greater than the predetermined time when the operations panel 41 or the like assigns the image formation initiating instruction to the controller 40, the controller 40 serves as a non-image forming discharge execution determining unit configured to execute the non-image forming discharge. Note that the aforementioned non-image forming discharge is carried out before printing as a pre-printing discharge, which is preparation of image formation. The non-image forming discharge is conducted before the initiation of the image forming operation.

If the controller 40 serving as the non-image forming discharge execution determining unit determines that the non-image forming discharge needs to be performed, the controller 40 retrieves the necessary non-image forming discharge amounts corresponding to the heads 61BK, 61C, 61M and 61Y stored in the ROM 51 and initiates the non-image forming discharge based on the retrieved necessary discharge amounts. In this aspect, the controller 40 serves as a maintenance discharge amount acquisition unit or a maintenance discharge drops acquisition unit (hereinafter referred to as the "maintenance discharge amount acquisition unit") configured to acquire the amounts of the recording liquids to be discharged from the nozzles of the heads 61BK, 61C, 61M and 61Y so as to allow the amounts of the discharged recording liquids to pass through the holes H. Note that the necessary discharge amount may be computed by utilizing a predetermined formula or the like based on the aforementioned conditions. In this case, the controller serves as a maintenance discharge amount computing unit or maintenance discharge drops computing unit (hereinafter referred to as the "maintenance discharge amount computing unit").

With such a configuration to allow the recording liquid to pass through the holes H in the transfer belt 11, contamination of the transfer belt 11 may be a concern or a necessary time to complete the non-image forming discharge may be a concern. That is, part of recording liquid droplets may be attached to a surface of the transfer belt 11 without allowing the recording liquid droplets to pass through the holes H in the transfer belt 11 while conducting the non-image forming discharge. In such a case, recording media (e.g., paper) subsequently transferred by the endless transfer belt 11 may be contaminated or other components arranged inside the image forming apparatus 100 may be contaminated while conducting the non-image forming discharge. However, if an amount discharged per hour of the necessary discharge amount of the recording liquid for the non-image forming discharge is simply reduced to reliably allow the liquid droplets to pass through the holes H while securing the necessary non-image forming discharge amount, it may take a long time to complete the non-image forming discharge.

Accordingly, in the image forming apparatus 100, the transfer belt moving motor driver 54 sets the driving speed of the transfer belt 11 based on the necessary discharge amount acquired by the controller 40 serving as the maintenance discharge amount acquisition unit. In this aspect, the controller 40 may serve as a belt traveling speed setting unit. The controller 40 serving as the belt traveling speed setting unit may specifically control the driving speed of the transfer belt 11 so as to increase the non-image forming discharge amount per hour passing through the transfer belt 11 by lowering the driving speed of the transfer belt 11. In this manner, the controller 40 improves the reliability in causing the recording liquid to pass through the holes H while the non-image forming discharge is carried out, and increases the necessary non-image forming discharge amount per hour, thereby controlling the necessary time to complete the non-image forming discharge.

The reasons for lowering the driving speed of the transfer belt 11 to increase the reliability in causing the recording liquid to pass through the holes H while the non-image forming discharge is carried out and increase the non-image forming discharge amount per hour are as follows.

As mentioned above, the effective diameter of the hole H may vary with the thickness of the transfer belt 11, a size of the liquid droplet in the thickness direction of the transfer belt 11 and the jetting speed of the liquid droplet in the thickness direction of the transfer belt 11. In addition, the effective diameter of the hole H may also vary with the driving speed of the transfer belt 11. If the driving speed of the transfer belt 11 is high, the moving amount of the transfer belt 11 while the liquid droplets are passing through the holes H is increased. Accordingly, the liquid droplets may easily become attached to the transfer belt 11. Thus, the effective diameter of the hole H may get larger as the driving speed of the transfer belt 11 is lowered. Accordingly, even if the non-image forming discharge amount per hour is increased as the driving speed of the transfer belt 11 is lowered, the recording liquid droplets easily pass through the holes H without allowing the recording liquid droplets to be attached to the transfer belt 11.

Thus, even if the jetting pitch of the recording liquids for the non-image forming discharge is the same as that of the recording liquids for the image forming discharge, it may be appropriate to increase the non-image forming discharge amount per unit length of the transfer belt 11 as the driving speed of the transfer belt 11 is lowered. Hence, the time to complete the non-image forming discharge may be reduced as the driving speed of the transfer belt 11 is lowered. Further, the airflow disturbance near the surface of the transfer belt 11 caused by the traveling of the transfer belt 11 and liquid droplets discharged in the disrupted jetting directions may be controlled as the driving speed of the transfer belt 11 is lowered. Accordingly, the reliability in causing the recording liquid to pass through the holes H may be improved.

In this embodiment, the controller 40 serving as the belt traveling speed setting unit determines the driving speed of the transfer belt 11 such that the necessary discharge amounts of the recording liquids are passed through the holes H composing one of the patterns X formed in the circumference of the endless transfer belt 11. With this configuration, the non-image forming discharge amount per unit length of the transfer belt 11 is increased, more specifically, to the maximum, and hence the non-image forming discharge may be most efficiently performed. The driving speed of the transfer belt 11 may be determined based on the necessary discharge amounts of the recording liquids. Since the necessary discharge amounts of the recording liquids vary with the above-described conditions, the driving speed of the transfer belt 11 may also vary with the above-described conditions.

Note that if the controller 40 serving as a belt traveling speed setting unit sets the driving speed of the transfer belt 11 for the non-image forming liquid discharge higher than that of the transfer belt 11 for image forming liquid discharge, the controller 40 may determine the driving speed of the transfer belt 11 for the non-image forming liquid discharge such that the necessary discharge amounts of the recording liquids pass through the number of holes H of the patterns X that is fewer than the total number of holes H of the patterns X provided in a circumference of the transfer belt 11. In this case, the airflow disturbance near the surface of the transfer belt 11 caused by the traveling of the transfer belt 11 may be reduced, which may further control the disrupted jetting directions of the liquid droplets. Thus, the reliability of the liquid droplets passing through the holes H may be improved.

On the other hand, when the necessary discharge amounts of the recording liquids are allowed to pass through the holes H to complete the non-image forming discharge, the transfer belt moving motor driver 54 sets the driving speed of the transfer belt 11 for the non-image forming discharge back to the original driving speed for the image forming discharge to initiate the formation of the images based on an image formation initiation instruction assigned via the operations panel 41 or the like.

Figure 7A:
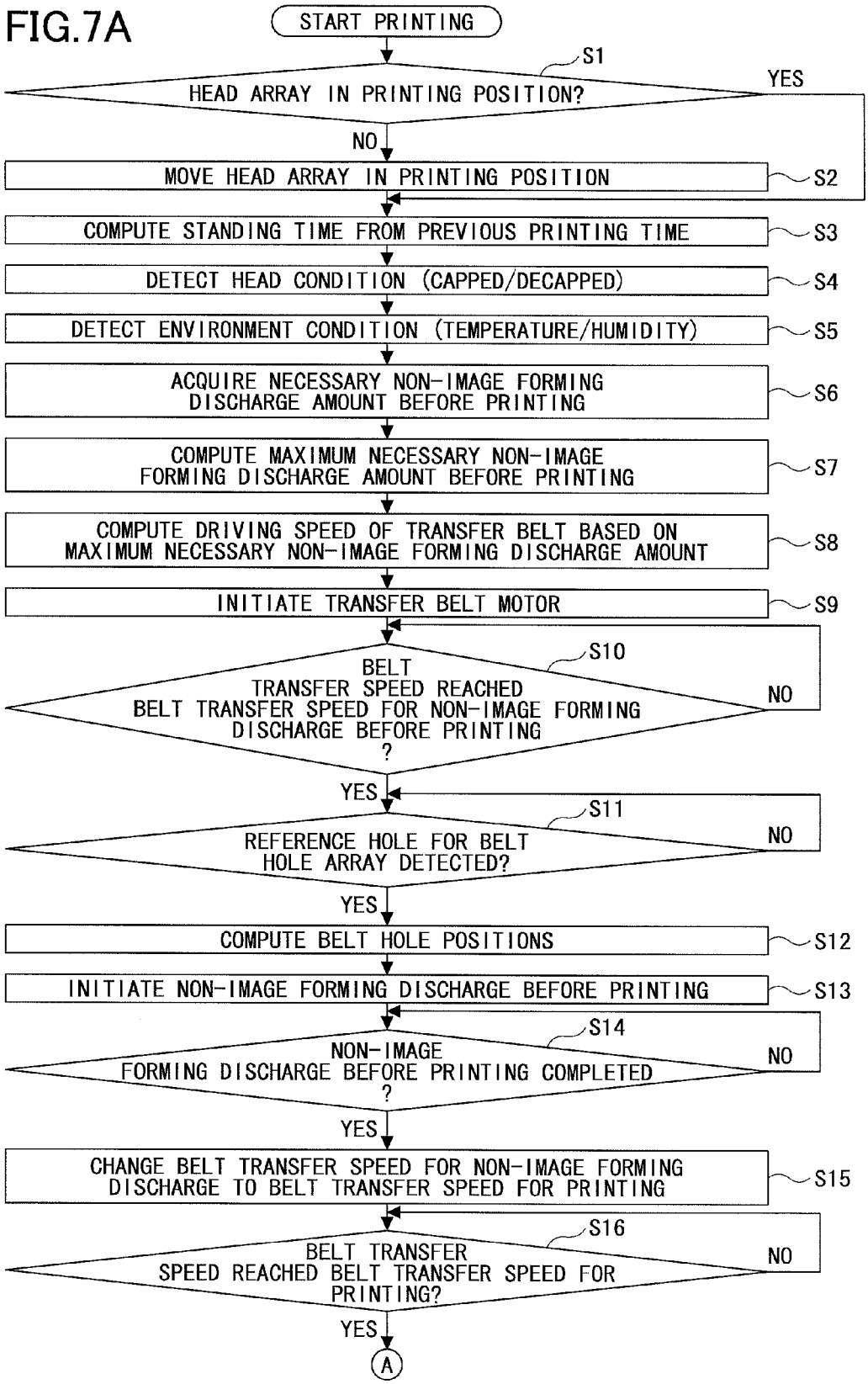
FIGS. 7A and 7B indicate a flowchart illustrating a process of maintaining the head in the image forming apparatus illustrated in FIG. 1.
Figure 7B:
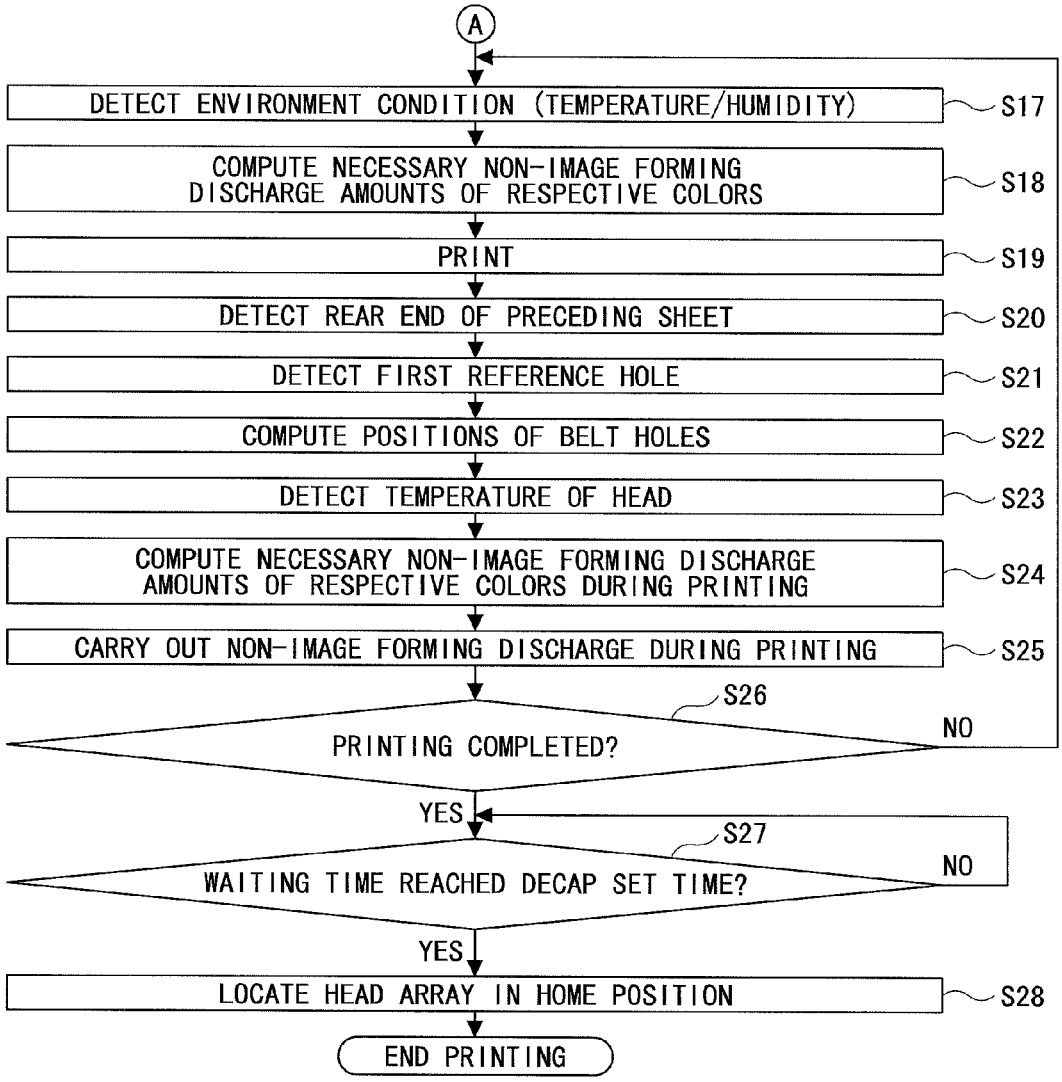

An example of an operational flow of the image forming apparatus 100 initiated by the assignment of the image formation initiation instruction when the conditions for carrying out the non-image forming discharge are satisfied is described with reference to FIG. 7. In the operations illustrated in FIGS. 7A and 7B, not only is the non-image forming discharge performed before the image forming operation is carried out, but the non-image forming discharge during the image forming operation is also carried out.

When the image formation initiating instruction is assigned, whether the head part 61 serving as a head array is located in a home position that is a printing position is determined (step S1). If the head part 61 or head array is not in the home position, the head moving drive unit moves the head part 61 to the home position (step S2). Then the waiting time that is the standing time is measured and computed by the timer 59 and the controller 40 respectively serving as the waiting time measuring unit and the waiting time computing unit (step S3). If the image formation initiating instruction is the monochrome image formation initiating instruction, the timer 59 and the controller 40 respectively serving as the waiting time measuring unit and the waiting time computing unit measure and compute the waiting time for the head 61BK alone. However, if the image formation initiating instruction is the color image formation initiating instruction, the timer 59 and the controller 40 respectively serving as the waiting time measuring unit and the waiting time computing unit measure and compute the respective waiting times of the heads 61BK, 61C, 61M and 61Y.

Subsequently, whether the head part 61 (i.e., the heads 61BK, 61C, 61M and 61Y) is in a capped or a decapped condition is detected (step S4). If the image formation initiating instruction is the monochrome image formation initiating instruction, whether the head 61BK is capped (in a capped condition) or decapped (in a decapped condition) is detected. However, if the image formation initiating instruction is the color image formation initiating instruction, whether the heads 61BK, 61C, 61M and 61Y are capped (in a capped condition) or decapped (in a decapped condition) is detected.

Subsequently, an environmental condition; that is, the environmental temperature and the environmental humidity are detected by utilizing the environment detecting sensor 56 (step S5). Then, the controller 40 serving as the maintenance discharge amount acquisition unit acquires the necessary non-image forming discharge amount(s) of the color(s) of the recording liquid(s) stored in the ROM 51 serving as the non-image forming discharge amount storing unit based on the various conditions resulted from steps S3 through S5 (step S6).

The maximum necessary non-image forming discharge amount of the recording liquid among the heads utilized for the image forming operation is computed based on the computed necessary non-image forming discharge amount(s) (step S7). The driving speed of the transfer belt 11 for allowing the maximum necessary non-image forming discharge amount of the recording liquid to pass through the holes H of the pattern X is computed (step S8). The driving of the transfer belt is initiated (step S9) and the controller 40 then waits until the driving speed of the transfer belt 11 reaches the computed driving speed (step S10).

When the driving speed of the transfer belt 11 has reached the computed driving speed, the controller 40 waits until the reference detecting sensor 35 detects the reference holes H' (step S11). When the reference detecting sensor 35 has detected the reference holes H', the positions of the holes H contained in the patterns X are computed (step S12). The non-image forming discharge is initiated such that the discharged recording liquid droplets for the non-image forming discharge match the positions of the holes H in the patterns X (step S13). The controller then waits until the necessary non-image forming discharge amounts of the recording liquids are discharged for the non-image forming discharge (step S14).

When the non-image forming discharge is in complete, the driving speed of the transfer belt 11 for the non-image forming discharge is changed to the driving speed of the transfer belt 11 for the image forming discharge (step S15). The controller 40 then waits until the driving speed of the transfer belt 11 reaches the driving speed of the transfer belt 11 for the image forming (i.e., printing) discharge (step S16).

Note that the non-image forming discharge is also carried out via the holes H in portions of the transfer belt 11 exposed between the transferred sheets P while the image forming operation (printing) is performed (step S25) in order to discharge the thickened ink that may be obtained due to the unused nozzles that have not discharged the recording liquids, the nozzles that have discharged the recording liquids a few times, and undischarged duration between the transferred sheets. Such a non-image forming discharge during printing may also be carried out so as to allow the recording liquids to pass through the holes H based on the positions of the holes H composing the patterns X.

It is preferable that the non-image forming discharge during image formation (printing) be carried out in the line-type inkjet recording apparatus such as the image forming apparatus 100. That is, the line-type inkjet recording apparatus is generally not provided with a configuration in which the non-image forming discharge is carried out by moving the heads in the width direction such that the discharged non-image forming recording liquids are received by non-image forming discharge receivers provided outside a recording medium transferring region. In this embodiment, the discharge position is provided away from the cleaning position. Likewise, the line type inkjet recording apparatus is provided with the caps at the cleaning position provided away from the discharge position. In the line type inkjet recording apparatus, if the recording liquids utilized for the non-image forming discharge are discharged into the caps, the productivity, which is the characteristic of the line type inkjet recording apparatus, may be lowered. Accordingly, it is preferable that the recording liquids utilized for the non-image forming discharge be discharged via the holes formed in the transfer belt in a similar manner as the non-image forming discharge performed before the image forming operation.

In this embodiment, after step S16 where the driving speed of the transfer belt 11 that has reached the driving speed of the transfer belt 11 for the image-forming discharge is detected, the following steps may be carried out prior to step S19 of initiating the image forming operation. That is, the environmental condition, namely, the environmental temperature and the environmental humidity are detected by the environment detecting sensor 56 (step S17), and subsequently, an interval time between the sheets and the necessary non-image forming discharge amounts of the respective colors are computed based on a distance between the sheets, a size of the sheets, and an image forming speed (step S18).

Further, after step S19 of initiating the image forming operation, the following steps are carried out prior to step S25 of performing the non-image forming discharge during the image forming operation. That is, a rear end of the preceding sheet is detected (step S20), and the first reference hole H' is then detected (step S21). The positions of the holes H contained in the pattern X are then computed (step S22). Subsequently, the temperature(s) of the head(s) utilized for the image forming operation are detected (step S23), and the necessary non-image forming discharge amounts of the respective colors during the image forming operation (printing) are then computed (step S24).

The necessary non-image forming discharge amounts of the respective colors during printing may be set based on the maximum interval time between the transferring sheets. Note that the non-image forming discharge during printing differs from the non-image forming discharge before printing (image formation) in that the traveling speed of the transfer belt 11 is set to be the traveling speed for the image forming operation. Further, if the starting point of the non-image forming discharge is the position of the reference hole H', the distance between the transferring sheets may need to be increased for carrying out the non-image forming discharge. In this manner, the productivity of printing may be degraded. Thus, in this embodiment, the non-image forming discharge is performed after the detection of the rear end of the sheet.

When the non-image forming discharge during image formation is carried out in step S25, whether the image forming operation has been completed is determined (step S26). If it is determined that the image forming operation has not been completed (No in step S26), the operations from steps S17 through S25 are repeated. If, on the other hand, it is determined that the image forming operation has been completed (Yes in step S26), whether the waiting time has reached a decap set time is determined (step S27). If the waiting time has reached a decap set time (Yes in step S27), the head part 61 is moved in the home position by the head moving drive unit (step S28), thereby completing the image forming operation.

The controller 40 serving as the maintenance discharge amount acquisition unit acquires the amounts of the recording liquids to be discharged from the nozzles of the heads 61BK, 61C, 61M and 61Y to be passed through the holes H for carrying out maintenance during the non-image forming operation by controlling the endless transfer belt 11 having plural holes H facing the heads 61BK, 61C, 61M and 61Y and configured to transfer the sheet P in the transferring direction perpendicular to the array direction of the nozzles provided in the heads 61BK, 61C, 61M and 61Y; the transfer belt moving motor 45 configured to rotationally drive the transfer belt 11; and the transfer belt moving motor driver 54 configured to control the driving speed of the transfer belt 11 rotationally driven by the transfer belt moving motor 45. The controller 40 stores in the ROM 51 a head maintenance program for executing a method for maintaining a head to set an appropriate driving speed of the transfer belt 11 driven by the transfer belt moving motor driver 54 based on the acquired amounts of the recording liquids discharged to be discharged from the respective nozzles. In this aspect, the controller 40 or the ROM 51 may serve as a head maintenance program storing unit. The head maintenance program may be stored in a semiconductor medium such as a RAM or a non-volatile memory; an optical medium such as a DVD, MO, MD, and CD-R; a magnetic medium such as a hard disk, a magnetic tape, and a flexible disk; and other recording media, in addition to the ROM 51 provided in the controller 40. If the head maintenance program is stored in the above memory or the other recording media, such recording media may be computer-readable.

The preferred embodiments of the invention are described above, however, the invention is not limited to those specifically described embodiments. Various modifications and alteration may be made within the scope of the invention described in the claims.

For example, in the above embodiments, the conditions for determining the necessary non-image forming discharge amounts are the same for the nozzles provided in the same head, and hence the necessary discharge amounts may be the same among the nozzles in the same head. However, the waiting times of the respective nozzles in the same head may be measured and the necessary discharge amounts for the nozzles may be set based on the measured waiting times of the respective nozzles in the same head. With this configuration, the necessary discharge amounts may differ amoung the nozzles provided in the same head. Further, the necessary non-image forming discharge amounts may be set by utilizing part of the conditions for determining the necessary non-image forming discharge amounts. Moreover, the conditions for determining the necessary non-image forming discharge amounts are not limited to those described above. The necessary non-image forming discharge amounts may be determined utilizing other conditions.

The non-image forming discharge may be performed every time the image forming operation is initiated. In the above example, black, cyan, magenta and yellow images are formed in this order from the upstream side to the downstream side of the arrow A1 direction. However, the order of forming the color images is not limited to that described above. For example, the color images may be formed in the order of black, magenta, cyan and yellow. The colors of the recording liquids discharged from the respective heads are not limited to those described above. Other colors of recording liquids such as secondary colors and gray ink may be discharged from the corresponding heads.

The image forming apparatus to which the embodiment is applied may not limited to that described above. Other types of the image forming apparatus may also be used insofar as the image forming apparatus is the inkjet type. Examples of the image forming apparatus include a copier, a single unit facsimile machine, a multifunctional peripheral combining a printer and any of the copier and the facsimile machine, an image forming apparatus utilized for forming electrical circuits, or an image forming apparatus for forming predetermined images in the biotechnological field.

According to an embodiment, there is provided an image forming apparatus that includes an endless belt having plural holes facing a head and configured to transfer a recording medium in a transferring direction perpendicular to an array direction of nozzles provided in the head; a driving speed control unit configured to control a driving speed of the endless belt driven by the driving unit; and a maintenance discharge amount acquisition unit configured to acquire an amount of a recording liquid to be discharged from the nozzles of the head to allow the amount of the recording liquid to be passed through the holes in the endless belt for performing maintenance during a non-image forming operation. In the image forming apparatus, the driving speed control unit sets the driving speed of the endless belt based on the amount of the recording liquid to be discharged from the nozzles of the head to allow the amount of the recording liquid to be passed through the holes in the endless belt acquired by the maintenance discharge amount acquisition unit. With this configuration, the reliability in allowing the recording liquid discharged for maintenance to pass through the holes in the endless belt may be improved and contamination of the endless belt with the discharged recording liquid may be reduced. Further, time taken until completing the discharge of the recording liquid may be reduced. Accordingly, the image forming apparatus may be capable of continuously exhibiting excellent image formation over time due to maintenance.

In the image forming apparatus according to the embodiment, the endless belt includes the holes forming plural patterns periodically arranged in the transferring direction, each of the patterns including a part of the holes arranged corresponding to jetting positions of the recording liquid discharged from the nozzles in the array direction when the endless belt makes a revolution; and the driving speed control unit sets the driving speed of the endless belt such that the amount of the recording liquid acquired by the maintenance discharge amount acquisition unit is passed through the part of the holes forming a part of the patterns arranged in the transferring direction while the endless belt makes one revolution. With this configuration, the reliability in allowing the recording liquid discharged for maintenance to pass through the holes in the endless belt may be improved and contamination of the endless belt with the discharged recording liquid may be reduced. Further, time taken until completing the discharge of the recording liquid may be reduced by allowing the recording liquid to be discharged from the nozzles of the head to pass through the part of the holes forming the part of the patterns arranged in the transferring direction while the endless belt makes one revolution. Accordingly, the image forming apparatus may be capable of continuously exhibiting excellent image formation over time due to maintenance.

In the image forming apparatus according to the embodiment, when the amount of the recording liquid acquired by the maintenance discharge amount acquisition unit is passed through the holes in the endless belt, the driving speed control unit sets the driving speed of the endless belt to be an image forming driving speed of the endless belt for performing an image forming operation. With this configuration, the reliability in allowing the recording liquid discharged for maintenance to pass through the holes in the endless belt may be improved and contamination of the endless belt with the discharged recording liquid may be reduced. Further, time taken until completing the discharge of the recording liquid may be reduced. Moreover, the driving speed of the endless belt may be appropriately set for performing the maintenance and the image forming operation. Accordingly, the image forming apparatus may be capable of continuously exhibiting excellent image formation over time.

In the image forming apparatus according to the embodiment, the maintenance discharge amount acquisition unit acquires the amount of the recording liquid to be discharged from the nozzles of the head to allow the amount of the recording liquid to be passed through the holes in the endless belt based on a non-discharge elapsed time during which the recording liquid has not been discharged from the nozzles. With this configuration, the amount of the recording liquid to be discharged from the nozzles of the head to allow the amount of the recording liquid to be passed through the holes in the endless belt for the maintenance may be appropriately discharged based on the non-discharge elapsed time. Further, the reliability in allowing the recording liquid discharged to pass through the holes in the endless belt may be improved and contamination of the endless belt with the discharged recording liquid may be reduced. Further, time taken until completing the discharge of the recording liquid may be reduced. Accordingly, the image forming apparatus may be capable of continuously exhibiting excellent image formation over time by maintenance.

In the image forming apparatus according to the embodiment, the maintenance discharge amount acquisition unit acquires the amount of the recording liquid to be discharged from the nozzles of the head to allow the amounts of the recording liquid to be passed through the holes in the endless belt based on whether the head is in a capped condition. With this configuration, the amount of the recording liquid to be discharged from the nozzles of the head to allow the amount of the recording liquid to be passed through the holes in the endless belt for the maintenance may be appropriately discharged based on whether the head is in the capped condition. Further, the reliability in allowing the recording liquid discharged to pass through the holes in the endless belt may be improved and contamination of the endless belt with the discharged recording liquid may be reduced. Further, time taken until completing the discharge of the recording liquid may be reduced. Accordingly, the image forming apparatus may be capable of continuously exhibiting excellent image formation over time by maintenance.

In the image forming apparatus according to the embodiment, the maintenance discharge amount acquisition unit acquires the amount of the recording liquid to be discharged from the nozzles of the head to allow the amount of the recording liquid to be passed through the holes in the endless belt based on at least one of an environmental temperature and an environmental humidity. With this configuration, the amount of the recording liquid to be discharged from the nozzles of the head to allow the amount of the recording liquid to be passed through the holes in the endless belt for the maintenance may be appropriately discharged based on at least one of the environmental temperature and the environmental humidity. Further, the reliability in allowing the recording liquid discharged to pass through the holes in the endless belt may be improved and contamination of the endless belt with the discharged recording liquid may be reduced. Further, time taken until completing the discharge of the recording liquid may be reduced. Accordingly, the image forming apparatus may be capable of continuously exhibiting excellent image formation over time by maintenance.

In the image forming apparatus according to the embodiment, the maintenance discharge amount acquisition unit acquires the amount of the recording liquid to be discharged from the nozzles of the head to allow the amount of the recording liquid to be passed through the holes in the endless belt based on a temperature of the head. With this configuration, the amount of the recording liquid to be discharged from the nozzles to allow the amount of the recording liquid to be passed through the holes in the endless belt for the maintenance may be appropriately discharged based on the temperature of the head. Further, the reliability in allowing the recording liquid discharged to pass through the holes in the endless belt may be improved and contamination of the endless belt with the discharged recording liquid may be reduced. Moreover, time taken until completing the discharge of the recording liquid may be reduced. Accordingly, the image forming apparatus may be capable of continuously exhibiting excellent image formation over time due to maintenance.

According to another embodiment, there is provided a method for maintaining a head in an image forming apparatus that includes an endless belt having plural holes facing the head. The method includes transferring a recording medium in a transferring direction perpendicular to an array direction of nozzles provided in the head; controlling a driving speed of the endless belt; and acquiring amounts of recording liquids discharged from the nozzles to be passed through the holes in the endless belt for performing maintenance during a non-image forming operation. In this method, the driving speed of the endless belt is set based on the acquired amounts of the recording liquids to be discharged from the nozzles of the head to allow the amount of the recording liquid to be passed through the holes in the endless belt. With this method, the reliability in allowing the recording liquid discharged for maintenance to pass through the holes in the endless belt may be improved and contamination of the endless belt with the discharged recording liquid may be reduced. Further, time taken until completing the discharge of the recording liquid may be reduced. Accordingly, the method for maintaining the head may be capable of continuously exhibiting excellent image formation over time due to maintenance.

The advantages illustrated above are merely examples of the most preferred ones provided by the embodiments, and therefore are not limited to those described in the embodiments.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese Priority Application No. 2010-152212 filed on Jul. 2, 2010, with the Japanese Patent Office, the entire contents of which are hereby incorporated by reference.

What is claimed is:

1. An image forming apparatus comprising:

an endless belt having plural holes facing a head and configured to transfer a recording medium in a transferring direction perpendicular to an array direction of nozzles provided in the head;

a driving unit configured to rotationally drive the endless belt;

a driving speed control unit configured to control a driving speed of the endless belt driven by the driving unit; and a maintenance discharge amount acquisition unit configured to acquire an amount of a recording liquid to be discharged from the nozzles of the head to allow the amount of the recording liquid to be passed through the holes in the endless belt for performing maintenance during a non-image forming operation, wherein the driving speed control unit sets the driving speed of the endless belt based on the amount of the recording liquid to be discharged from the nozzles of the head to allow the amount of the recording liquid to be passed through the holes in the endless belt acquired by the maintenance discharge amount acquisition unit, and wherein the endless belt includes the holes forming plural patterns periodically arranged in the transferring direction, each of the patterns including a part of the holes arranged corresponding to jetting positions of the recording liquid discharged from the nozzles in the array direction when the endless belt makes a revolution, and wherein the driving speed control unit sets the driving speed of the endless belt such that the amount of the recording liquid acquired by the maintenance discharge amount acquisition unit is passed through the part of the holes forming a part of the patterns arranged in the transferring direction while the endless belt makes one revolution.

2. The image forming apparatus as claimed claim 1, wherein, when the amount of the recording liquid acquired by the maintenance discharge amount acquisition unit is passed through the holes in the endless belt, the driving speed control unit sets the driving speed of the endless belt to be an image forming driving speed of the endless belt for performing an image forming operation.

3. The image forming apparatus as claimed in claim 1, wherein the maintenance discharge amount acquisition unit acquires the amount of the recording liquid to be discharged from the nozzles of the head to allow the amount of the recording liquid to be passed through the holes in the endless belt based on a non-discharge elapsed time during which the recording liquid has not been discharged from the nozzles.

4. The image forming apparatus as claimed in claim 1, wherein the maintenance discharge amount acquisition unit acquires the amount of the recording liquid to be discharged from the nozzles of the head to allow the amount of the recording liquid to be passed through the holes in the endless belt based on whether the head is in a capped condition.

5. The image forming apparatus as claimed in claim wherein the maintenance discharge amount acquisition unit acquires the amount of the recording liquid to be discharged from the nozzles of the head to allow the amount of the recording liquid to be passed through the holes in the endless belt based on at least one of an environmental temperature and an environmental humidity.

6. The image forming apparatus as claimed in claim 1, wherein the maintenance discharge amount acquisition unit acquires the amount of the recording liquid to be discharged from the nozzles of the head to allow the amount of the recording liquid to be passed through the holes in the endless belt based on a temperature of the head.

7. The image forming apparatus as claimed in claim 1, wherein, when the amount of the recording liquid acquired by the maintenance discharge amount acquisition unit is passed through the holes in the endless belt, the driving speed control unit sets the driving speed of the endless belt to be an image forming driving speed of the endless belt for performing an image forming operation.

8. A method for maintaining a head in an image forming apparatus including an endless belt having plural holes facing the head, the method comprising:

transferring a recording medium in a transferring direction perpendicular to an array direction of nozzles provided in the head;

controlling a driving speed of the endless belt; and acquiring, by a maintenance discharge amount acquisition unit of the image forming apparatus an amount of a recording liquid discharged from the nozzles to be passed through the holes in the endless belt for performing maintenance during a non-image forming operation, wherein the driving speed of the endless belt is set, by a driving speed control unit of the image forming apparatus, based on the acquired amount of the recording liquid to be discharged from the nozzles of the head to allow the amount of the recording liquid to be passed through the holes in the endless belt, and wherein the endless belt includes the holes forming plural patterns periodically arranged in the transferring direction, each of the patterns including a part of the holes arranged corresponding to letting positions of the recording liquid discharged from the nozzles in the array direction when the endless belt makes a revolution, and wherein the driving speed control unit sets the driving speed of the endless belt such that the amount of the recording liquid acquired by the maintenance discharge amount acquisition unit is passed through the part of the holes forming a part of the patterns arranged in the transferring direction while the endless belt makes one revolution.

* * * * *